United States Patent [19]

Kurihara

[11] 4,388,905

[45] Jun. 21, 1983

[54] AIR-FUEL RATIO CONTROL SYSTEM

[75] Inventor: Toshiro Kurihara, Koganei, Japan

[73] Assignees: Fuji Jukogyo Kabushiki Kaisha, Tokyo; Nissan Motor Co., Ltd., Yokohama, both of Japan

[21] Appl. No.: 280,968

[22] Filed: Jul. 7, 1981

[30] Foreign Application Priority Data

Jul. 16, 1980 [JP] Japan ..... 55-97359

[51] Int. Cl.[3] ..... F02M 7/20

[52] U.S. Cl. ..... 123/440; 123/489

[58] Field of Search ..... 123/440, 489, 492

[56] References Cited

U.S. PATENT DOCUMENTS 4,144,847 3/1979 Hosaka ..... 123/489 X 4,187,812 2/1980 Hosaka et al. ..... 123/440

4,240,389 12/1980 Shimazaki ..... 123/440 X

*Primary Examiner*—Tony M. Argenbright

*Attorney, Agent, or Firm*—Martin A. Farber

[57] ABSTRACT

A system for controlling the air-fuel ratio for a carburetor for an internal combustion engine having an intake passage, an exhaust passage, a throttle valve, a detector for detecting the concentration of a constituent of the exhaust gases, an on-off type electromagnetic valve for correcting the air-fuel ratio of the air-fuel mixture supplied by an air-fuel mixture supplier and an electronic controller. The electronic controller comprises a judging circuit for comparing the output signal of the detector with a stoichiometric reference signal, for driving the on-off electromagnetic valve for controlling the air-fuel ratio to a value approximating the stoichiometric air-fuel ratio. A load sensor and an engine temperature sensor are provided respectively. A correcting circuit renders the electronic controller non-responsive to the detector, when the engine temperature sensor actuates in the cold engine operation and responsive to the output of the load sensor, whereby the on-off electromagnetic valve operates in accordance with the output of the sensor.

15 Claims, 7 Drawing Figures

AIR-FUEL RATIO CONTROL SYSTEM

BACKGROUND OF THE INVENTION

The present invention relates to an air-fuel ratio control system for an internal combustion engine emission control system with a three-way catalytic converter, and more particularly to a system for an engine mounted on a car effective during a cold engine condition so as to improve the emission control effect and driveability of the car.

In a cold engine condition, evaporation of the fuel supplied by the carburetor of the engine decreases. Particularly, this is extreme during acceleration of the engine, since the engine induction vacuum is low in the wide-open throttle operating condition for acceleration. As a result, the fuel tends to adhere to the wall of the induction passage of the engine. Consequently, the air-fuel ratio of the air-fuel mixture to be induced in the engine increases (lean air-fuel mixture), which will cause stumbling of the engine operation and decrease the driveability of the car. In addition, if the throttle valve is closed immediately after such an acceleration, the fuel which has adhered to the wall of the induction passage is greatly evaporated by the high vacuum pressure in the induction passage. Thus, the mixture is excessively enriched by the evaporated fuel, which results in an increase of the amount of harmful constituents in the exhaust gases.

In a conventional air-fuel ratio control system, when the temperature of the cooling water of the engine is lower than a predetermined value, the air-fuel ratio of the mixture is controlled to a ratio smaller than the stoichiometric air-fuel ratio, that is a rich mixture. However, it is difficult for the control system to improve the driveability of the car without increasing the amount of unburned constituents of the exhaust gases.

SUMMARY OF THE INVENTION

The object of the present invention is to provide an air-fuel ratio control system which may control the air-fuel ratio to fulfil both the improvement of the driveability and the decrease of the unburned constituents of the exhaust gases during the cold engine operation. To this end, in accordance with the present invention, the air-fuel ratio control operation is dependent on the degree of opening of the throttle valve during the cold engine operation.

According to the present invention, there is a system for controlling the air-fuel ratio for a carburetor of an internal combustion engine having an induction passage, a throttle valve, an exhaust passage, first detecting means for detecting the concentration of a constituent of the exhaust gases passing through said exhaust passage and providing a detected output signal dependent thereon, air-fuel mixture supply means, and an on-off type electromagnetic valve for correcting the air-fuel ratio of the air-fuel mixture supplied by said air-fuel mixture supply means, with the improvement comprising electronic control means comprising a judging circuit means for comparing the detected output signal of said first detecting means with a reference value corresponding to a stoichiometric air-fuel ratio value and for producing a first output signal dependent on the difference, and a first circuit means for producing a driving output for driving said electromagnetic valve means dependent on the first output signal of said judging circuit means for controlling the air-fuel ratio to a value approximately equal to the stoichiometric air-fuel ratio, second detecting means for sensing load of said engine and for producing an output signal dependent thereon, third detecting means for sensing the cold engine operation and for producing an output signal dependent thereon, and correcting circuit means adapted to be operated by said output signal of said third detecting means for making said electronic control means effectively non-responsive to the detected output signal from said first detecting means and for operatively connecting said second detecting means to said first circuit means.

With the above and other objects and advantages in view, the present invention will become more clearly understood in connection with the detailed description of a preferred embodiment, when considered with the accompanying drawings, of which:

DETAILED DESCRIPTION OF THE PREFERRED EMBODIMENTS

Figure 1:
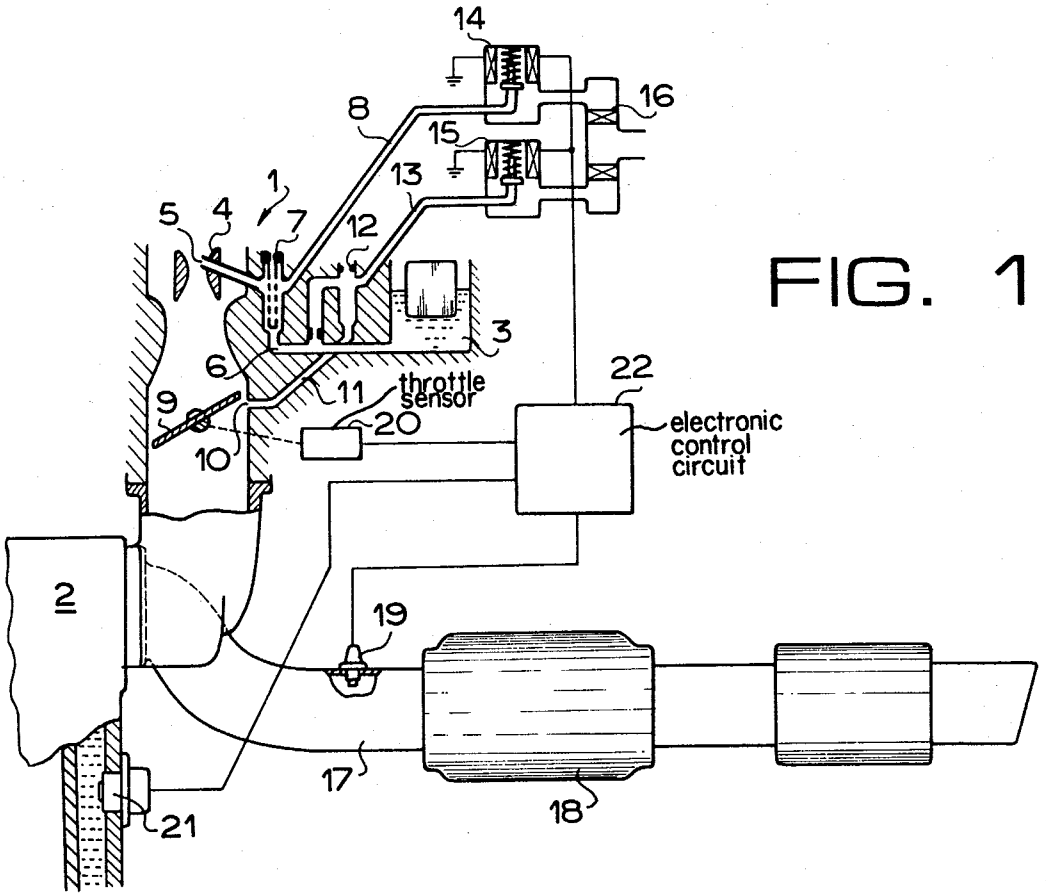
FIG. 1 is a schematic view of a system for controlling air-fuel ratio according to the present invention.

Referring to FIG. 1, numeral 1 designates a carburetor communicating with an internal combustion engine 2. The carburetor comprises a float chamber 3, a venturi 4, a nozzle 5 communicating with the float chamber 3 through a main fuel passage 6, and a slow port 10 which is opens near a throttle valve 9 and communicates with the float chamber 3 through a slow fuel passage 11. Air correcting passages 8 and 13 are provided parallel to a main air bleed 7 and a slow air bleed 12, respectively. On-off electromagnetic valves 14 and 15 are provided for the air correcting passages 8 and 13. An inlet port of each on-off electromagnetic valve communicates with the atmosphere through an air cleaner 16. An $O_2$ sensor 19 is provided on an exhaust pipe 17 upstream of a three-way catalytic converter 18 for detecting the oxygen content of the exhaust gases. A throttle sensor 20 is provided to detect the opening degree of the throttle valve 9. Further, a cooling water sensor 21 is provided on the jacket for the cooling water for detecting the temperature of the water. Outputs of the $O_2$ sensor 19, the throttle sensor 20 and the cooling water sensor 21 are connected to an electronic control circuit 22 for actuating on-off electromagnetic valves 14 and 15 to control the air-fuel ratio of the mixture to a proper value as will be described hereinafter.

Figure 2:
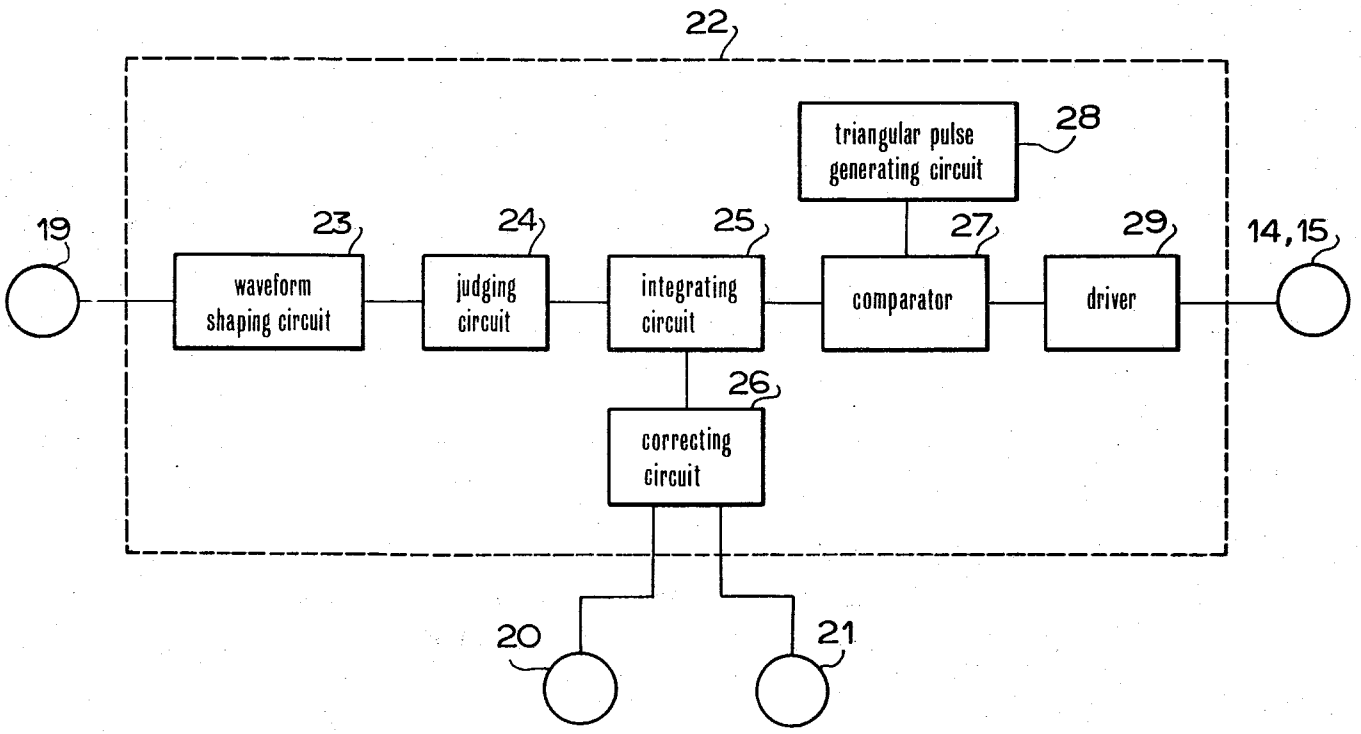
FIG. 2 is a block diagram of an electronic control circuit according to the present invention.

Referring to FIG. 2, the electronic control circuit is shown in dashed lines and the output of the $O_2$ sensor 19 is applied to an integrating circuit 25 through a waveform shaping circuit 23 and a judging circuit 24. The judging circuit 24 comprises a comparator for comparing the input thereto with a standard value to produce an output for the integrating circuit 25. Outputs of the throttle sensor 20 and the cooling water sensor 21 are connected to a correcting circuit 26 which in turn is connected to the integrating circuit 25. The integrating circuit 25 is connected to a comparator 27 which is adapted to produce square wave pulses by comparing the input thereof with a triangular pulse train fed from a triangular pulse generating circuit 28. The resulting square wave pulses are fed to a driver 29 for driving the electromagnetic valves 14 and 15.

Figure 3:
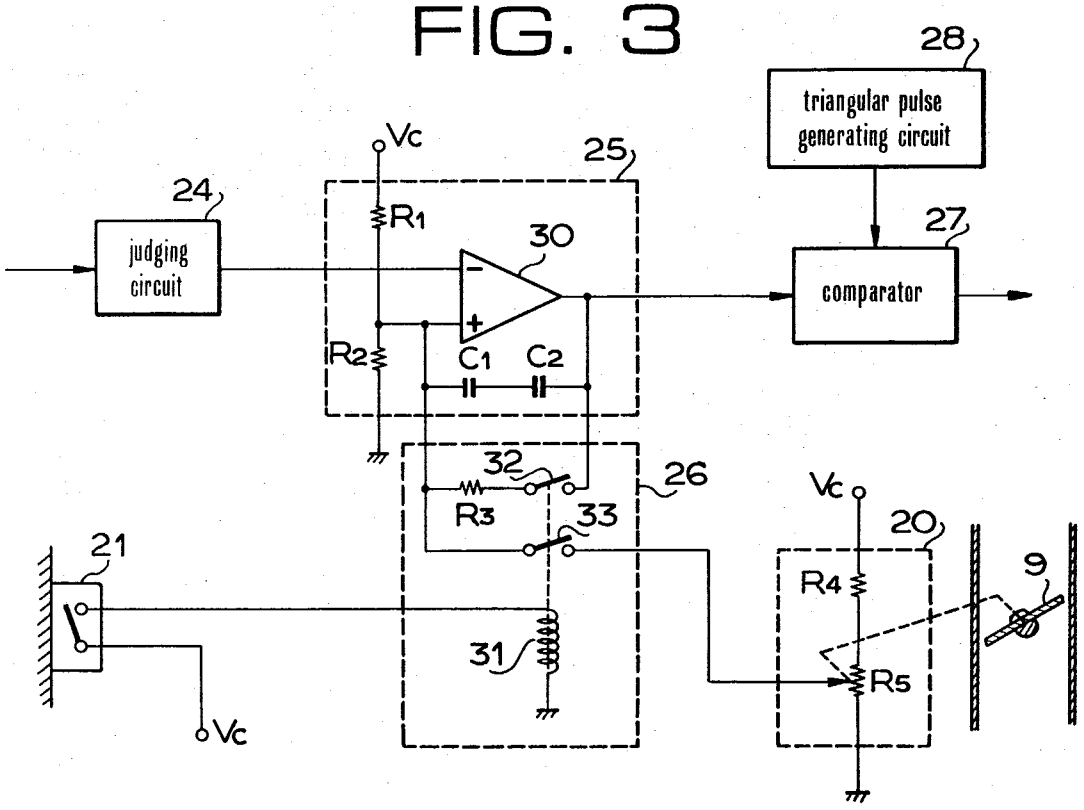
FIG. 3 shows a part of the electronic control circuit of FIG. 2 in detail.

Referring to FIG. 3, the integrating circuit 25 comprises an operational amplifier 30, inverting input thereof is connected to the judging circuit 24 and the output is connected to the comparator 27. The non-inverting input of the operational amplifier 30 is applied with a voltage divided by resistors $R_1$ and $R_2$. Between the non-inverting input and the output, capacitors $C_1$ and $C_2$ are connected in series. The correcting circuit 26 comprises a relay coil 31, relay contacts 32 and 33 and a resistor $R_3$. The relay contact 32 and resistor $R_3$ are connected in series between the noninverting input and the output of the amplifier 30. The relay contact 33 is connected between the non-inverting input and a variable resistor $R_5$ which constitutes the throttle sensor 20 together with a resistor $R_4$. The slider of the variable resistor $R_5$ is connected to the throttle valve shaft. The relay coil 31 is connected to the contact of the cooling water sensor 21 which is adapted to be opened when the temperature of the cooling water rises above a predetermined temperature.

When the temperature of the cooling water is higher than the predetermined temperature, the contact of the cooling water sensor 21 is opened. Accordingly, contacts 32 and 33 are opened. Oxygen concentration in the exhaust gases is detected by the $O_2$ sensor 19 and represented as an electric output voltage which is applied to the judging circuit 24. The judging circuit 24 judges whether the input voltage is higher or lower than the standard value corresponding to the stoichiometric air-fuel ratio to produce a rich or lean signal. The signal is integrated in the integrating circuit 25. The comparator 27 compares the output of the integrating circuit 25 with the triangular pulses fed from the triangular pulse generating circuit 28 to produce square pulses. The square pulses are fed to the on-off electromagnetic valves 14 and 15 through the driver 29, so that the electromagnetic valves are driven at the duty ratio of the square pulses. Thus, the air-fuel ratio of the mixture is controlled to the stroichiometric air-fuel ratio.

Figure 4:
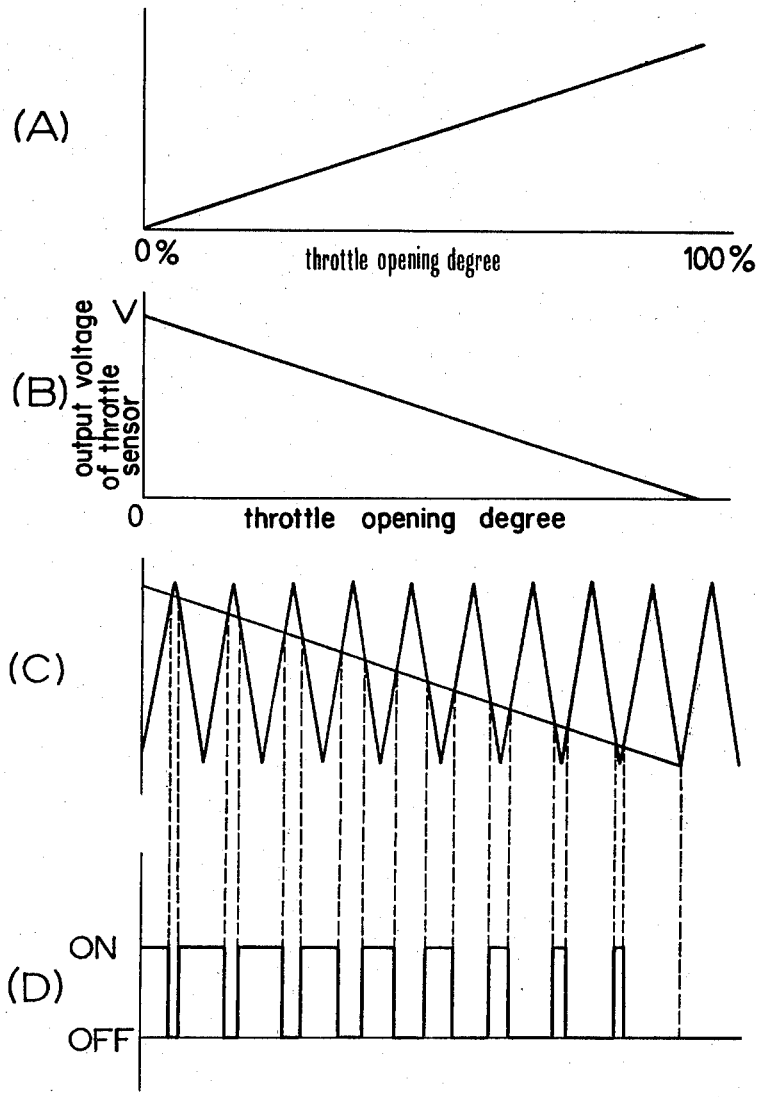
FIGS. 4A–4D show waveforms in some portions in the circuit of FIG. 2.

In the case that the temperature of the cooling water is below or not above the predetermined temperature, the contact of the cooling water sensor 21 is closed. Relay contacts 32 and 33 are closed, so that the operational amplifier 30 is converted so as to act as a normal amplifier and the voltage by the variable resistor $R_5$ is applied to the non-inverting input of the operational amplifier 30. The stoichiometric feedback control circuit is thus non-responsive to the detected signal from the $O_2$-sensor 19, i.e. it no longer performs its function of stoichiometric feedback control, e.g. particularly, by being non-responsive to the output from the judging circuit 24 in the manner that the integrating circuit no longer performs its integrating function for the stoichiometric feedback control. The voltage at the wiper of the variable resistor $R_5$, that is the output voltage of the throttle sensor 20, is high in the closed throttle condition and the voltage decreases with increase of the opening degree of the throttle valve. FIGS. 4A and 4B show variation of the throttle opening degree and variation of the output voltage of the throttle sensor 20. The operational amplifier 30 amplifies the input voltage from the throttle sensor 20. The comparator 27 compares the output of the amplifier 30 with the triangular pulses from the triangular pulse generating circuit 28. FIGS. 4C and 4D show the comparison of the output voltage and the triangular pulses and the thereby produced square waves. As shown in FIGS. 4A and 4D, the duty ratio of the square pulse decreases with an increase of the throttle opening degree. Accordingly, when the accelerator pedal is depressed for acceleration, rich air-fuel mixture is induced in the engine. Thus, it is possible to prevent stumbling of the engine operation. In the steady state condition of the engine, the throttle opening degree is small and a lean air-fuel mixture is supplied to the engine. Therefore, the amount of the harmful constituents in the exhaust gases does not increase.

Although the engine load is detected by the throttle sensor 20 in the illustrated system, another sensor such as a vacuum sensor for detecting the negative pressure in the induction passage may be employed.

In accordance with the present invention, since the air-fuel ratio of the mixture is controlled in dependency on the engine operation in the cold engine, condition, both driveability of the engine and reduction of harmful constituents in the exhaust gases may be improved.

What is claimed is:

1. In a system for controlling the air-fuel ratio control for a carburetor of an internal combustion engine having an induction passage, a throttle valve, an exhaust passage, first detecting means for detecting the concentration of a constituent of exhaust gases passing through said exhaust passage and providing a detected output signal dependent thereon, air-fuel mixture supply means, and an on-off type electromagnetic valve for correcting the air-fuel ratio of the air-fuel mixture supplied by said air-fuel mixture supply means, the improvement comprising electronic control means comprising a judging circuit means for judging the detected output signal of said first detecting means with a reference value corresponding to a stoichiometric air-fuel ratio value and for producing a first output dependent on the difference, and a first circuit means for producing a second output for driving said electromagnetic valve means operatively dependent on the first output of said judging circuit means for controlling the air-fuel ratio to a value approximately equal to the stoichiometric air-fuel ratio, second detecting means for sensing engine load and for producing a third output dependent thereon, third detecting means for sensing cold engine operation and for producing a fourth output dependent thereon, and correcting circuit means adapted to be operated by said fourth output of said third detecting means for making said electronic control means non-responsive to the detected output signal from said first detecting means and for operatively connecting the third output of said second detecting means to said first circuit means.

2. The system as set forth in claim 1, wherein said electronic control means includes means comprising an integrating circuit operatively connected to said judging circuit means for integrating said first output of said judging circuit means and to said first circuit means, the latter constituting a driving circuit means, said correcting circuit means is for making said integrating circuit non-responsive to said first output of said judging circuit means.

3. The system as set forth in claim 1, wherein said first circuit means comprises an integrating circuit for integrating said first output of said judging circuit means for operation of said electronic control means, said correcting circuit means is for converting said integrating circuit into an amplifier and for connecting said third output of said second detecting means to an input of said amplifier, whereby said integrating circuit is made non-responsive to said first output of said judging circuit means.

4. The system as set forth in claim 2, wherein said integrating circuit comprises an operational amplifier having an inverting input connected to said first output of said judging circuit means and a non-inverting input applied with a predetermined voltage and an output operatively connected to said driving circuit means, at least one capacitor being connected between said output of said operational amplifier and said non-inverting input, said correcting circuit comprises first and second relay contacts and a relay coil operatively ganged to said relay contacts, a resistor connected in series to said first relay contact and together in series connected across said non-inverting input and said output of said operational amplifier, said second relay contact is connected between said non-inverting input and said third output of said second detecting means, said relay coil is connected to said third detecting means, said third detecting means comprises a contact means for opening when the temperature of the engine operation rises above a predetermined temperature, said relay coil constitutes means for opening said relay contacts when said contact means of said third detecting means is opened above said predetermined temperature, whereby said integrating circuit is non-responsive to said third output of said second detecting means, said relay contacts and said contact means are closed when the temperature of the engine operation is at most equal to said predetermined temperature, whereby said operational amplifier via said first relay contact is converted into a normal amplifier and via said second relay contact is connected to said third output of said second detecting means, said second detecting means for making said third output a high voltage when said throttle valve is closed and progressively lower as said throttle valve opens.

5. The system as set forth in claim 4, wherein said second detecting means comprises a throttle sensor having a variable resistor applied with a voltage and including a wiper mechanically connected to said throttle valve, said third output of said second detecting means, is at said wiper, said variable resistor, said voltage applied thereto and said wiper connected to said throttle valve are arranged such that said third output at said wiper is said high voltage when said throttle valve is closed and progressively lower as said throttle valve opens.

6. The system as set forth in claim 4, wherein said second detecting means comprises a vacuum sensor means for detecting negative pressure in the induction passage and providing said third output as the voltage dependent thereon.

7. The system as set forth in claim 1, wherein said second detecting means comprises a throttle sensor having a variable resistor applied with a voltage and including a wiper mechanically connected to said throttle valve, said third output of said second detecting means, is at said wiper, said variable resistor, said voltage applied thereto and said wiper connected to said throttle valve are arranged such that said third output at said wiper is a high voltage when said throttle valve is closed and progressively lower as said throttle valve opens.

8. The system as set forth in claim 1, wherein said second detecting means comprises a vacuum sensor means for detecting negative pressure in the induction passage and providing said third output as a voltage dependent thereon.

9. The system as set forth in claim 1, wherein said first circuit means comprises an integrating circuit for integrating said first output of said judging circuit means for operation of said electronic control means and is connected to said judging circuit means, said correcting circuit means is for making said integrating circuit non-responsive to said first output of said judging circuit means.

10. The system as set forth in claim 1, wherein said second detecting means for making said third output a high voltage when said throttle valve is closed and progressively lower as said throttle valve opens.

11. The system as set forth in claim 2, wherein said second detecting means for making said third output a high voltage when said throttle valve is closed and progressively lower as said throttle valve opens.

12. The system as set forth in claim 3, wherein said second detecting means for making said third output a high voltage when said throttle valve is closed and progressively lower as said throttle valve opens.

13. The system as set forth in claim 9, wherein said second detecting means for making said third output a high voltage when said throttle valve is closed and progressively lower as said throttle valve opens.

14. The system as set forth in claim 2, wherein said third detecting means is a sensor means for detecting the temperature of the engine cooling water.

15. In a system for controlling the air-fuel ratio control for a carburetor of an internal combustion engine having an induction passage, a throttle valve, an exhaust passage, first detecting means for detecting the concentration of a constituent of exhaust gases passing through said exhaust passage and providing a detected output signal dependent thereon, air-fuel mixture supply means, and an on-off type electromagnetic valve for correcting the air-fuel ratio of the air-fuel mixture supplied by said air-fuel mixture supply means, the improvement comprising electronic control means comprising a judging circuit means for judging the detected output signal of said first detecting means with a reference value corresponding to a stoichiometric air-fuel ratio value and for producing a first output dependent on the difference, and an integrating circuit means for producing a second output for driving said electromagnetic valve means dependent on the first output of said judging circuit means for controlling the air-fuel ratio to a value approximately equal to the stoichiometric air-fuel ratio, second detecting means for sensing engine load and for producing a third output dependent thereon, third detecting means for sensing the cold engine operation and for producing a fourth output dependent thereon, and correcting circuit means adapted to be operated by said fourth output of said third detecting means for changing said integrating circuit to an amplifier and for operatively connecting said third output of said second detecting means to the input of said integrating circuit means.

* * * * *